United States Patent [19]

Foster

[11] 3,959,795

[45] May 25, 1976

[54] AERIAL ASSEMBLY WITH COMBINATION TOWER-GUIDE

[76] Inventor: Robert J. Foster, 515 S. 56th St., Omaha, Nebr. 68106

[22] Filed: Aug. 7, 1972

[21] Appl. No.: 278,749

[52] U.S. Cl. ..... 343/883; 52/121

[51] Int. Cl.[2] ..... H01Q 1/10; H01Q 1/12

[58] Field of Search ..... 52/111, 115, 121; 343/880, 883, 888, 890, 891; 182/142, 145, 146

[56] References Cited

UNITED STATES PATENTS

| | | | |
|---|---|---|---|
| 2,740,504 | 4/1956 | Bailey | 52/121 |
| 2,822,067 | 2/1958 | Price | 52/121 |
| 2,966,811 | 1/1961 | Sundt | 343/766 |
| 2,983,342 | 5/1961 | Howard | 343/883 |
| 3,318,414 | 5/1967 | Meek | 182/146 |
| 3,327,437 | 6/1967 | Rush | 52/121 |

*Primary Examiner*—Eli Lieberman

[57] ABSTRACT

An aerial assembly comprising an upright tower of the type having attached vertical sections and an aerial standard carriage slidably attached to the tower and slidable along the tower, said tower serving the main upholding strength of the entire assembly and yet also serving as a guide-track.

5 Claims, 5 Drawing Figures

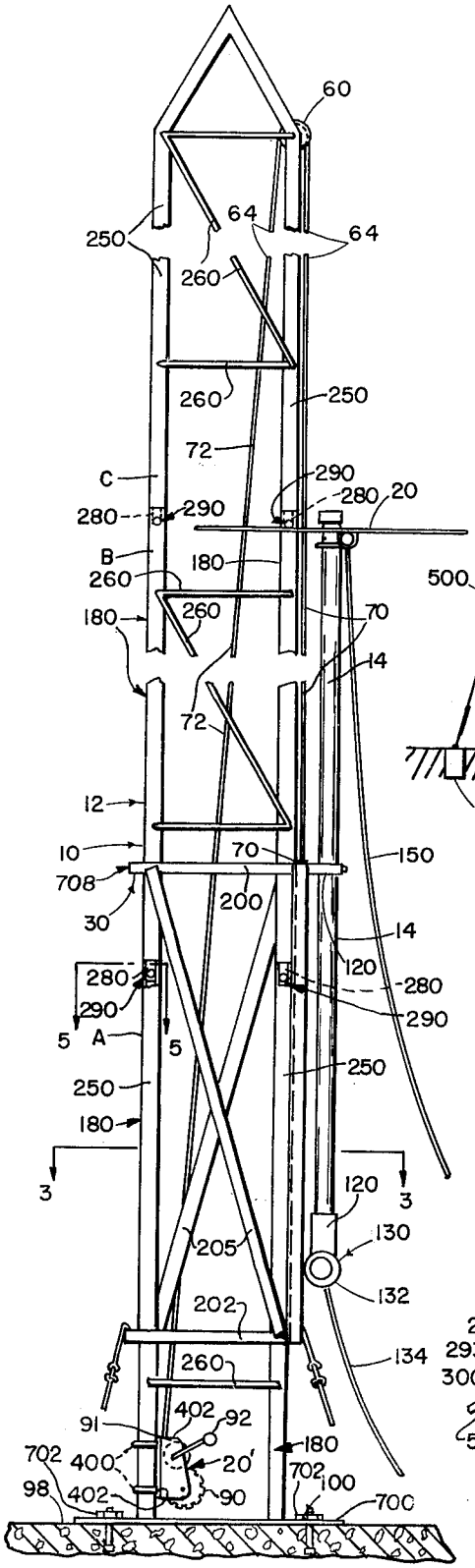
FIG. 1
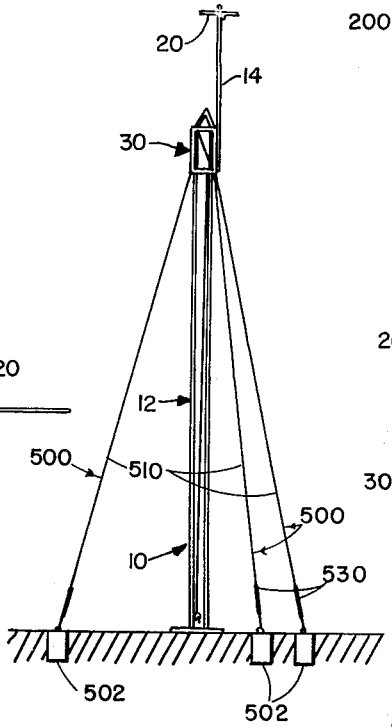
FIG. 4
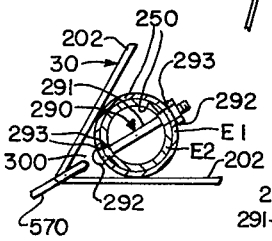
FIG. 5
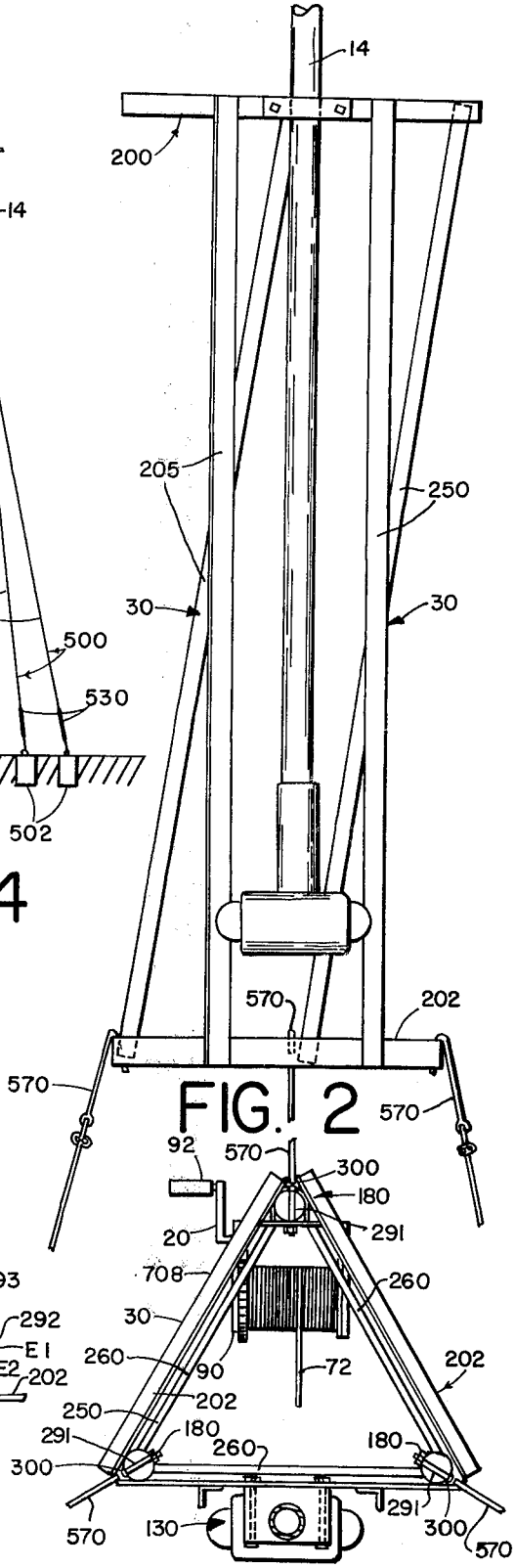
FIG. 2
FIG. 3

AERIAL ASSEMBLY WITH COMBINATION TOWER-GUIDE

FIELD OF THE INVENTION

This invention is in the field of aerial support assemblies of a type having a light, fabricated tower which is so tall that such towers are made in vertical sections for sectional shipping and having an antenna section thereon movable upwardly or downwardly with respect to the mast or tower section.

DESCRIPTION OF THE PRIOR ART

A serious problem has never been answered for the mounting of antennas high in the air on small city lots.

An amateur radio station operator has been able to purchase an antenna tower on which his antenna is fixed at the top, but with such installations, there is no way of servicing the antenna without physically climbing a 40 or 60-foot tower to disconnect and lower the antenna and make such changes as are needed.

Wind storms and hurricanes also tend to cause breakage on the fixed antenna tower installations and define a second disadvantage because it is desirable that an antenna be lowered from its great height whenever a wind storm or hurricane warning is out.

To answer this problem, industry has provided a tower having a tilting upper portion which is normally erect, but which is pivoted to the lower supporting portion of the tower so that the upper portion can be lowered from its erect position down through a horizontal position and on to where the antenna is near the ground where it can be serviced and where it is safe from hurricanes.

However, the tilting-upper-half-antenna-tower type of installation has the disadvantage that it cannot be installed where the tilting downwardly of the upper half of the tower would cause the antenna to strike trees, high telephone poles, garages, or extend across a lot-line into a neighbor's yard. And so the problem of an economic and practical mass marketable and shippable antenna has remained an unsolved problem through the decades.

A still further disadvantage of the tilting upper section tower is that when the upper section is in a horizontal position, it must be counterbalanced like one side of a child's teeter-totter is counterbalanced by the other end by a counterbalancing section which is on the other side of the pivoter hinge and is horizontal when the upper section is horizontal; vertical, and extending downwardly from the pivoter hinge when the upper tower section is upright in use position, and extending awkwardly and in an unsightly manner upwardly when the upper section of the tower is in a position lower than horizontal, making a tower with an antenna serviceable without a serviceman or owner physically climbing 40 or 60 feet into the air to disconnect and lower the antenna.

Industry has provided a telescoping tower as another answer to the problem. A telescoping tower has multiple tower sections, one inside the other, the outer section being mounted on the ground and the inner sections being raisable and lowerable upwardly and downwarrdly through the outer section.

A disadvantage of telescoping towers is that their sections are seldom less than 20 feet high which means that even when the tower is sufficiently collapsed, the top of the top section is still 20 feet above the ground where the antenna is still difficult to service, repair, or change.

Also, in a really violent storm or hurricane, to have a fragile amateur's radio antenna as high as 20 feet above the ground could still result in breakage.

And so neither the tilting or the telescoping antenna towers which industry has made available to radio amateur stations have solved these major problems for ease of servicing by substantially complete lowering of the antenna to achieve a safer height for preventing wind storm antenna damage.

Since solving this problem, I have been made aware of two earlier patents and one earlier publication showing proposals which would attempt to solve similar antenna problems, but which would not do so in ways fit for industrial manufacture, shipping, and merchandising, in my opinion.

The disadvantages thereof can be summarized by stating that these proposals would result in unsightly installations involving the use of a wooden telephone pole as the main strength of such a tower. A telephone pole is itself symmetrical and not necessarily unattractive because of its symmetry, but when used as only a part of an installation wherein the other parts of the installation cause great loss of symmetry, then the result is unsightly.

The radio amateur has his station at home, his mast is in his backyard, his yard is usually grassed and used for patio parties, family out-door eating, and in general, is an area were beauty is desired.

SUMMARY OF THE INVENTION

An aerial assembly having an elongated upright tower, the tower having at least three elongated upright corner posts, the corner posts each being formed of a plurality of upright posts disposed one above another and connected together at adjacent ends respectively, an aerial carriage slidable upwardly and downwardly on the tower and surrounding and guided by all of the three corner posts, an aerial attached to said carriage, and means on the tower and connected to the carriage for moving the carriage upwardly on the tower, whereby the tower serves as the main upholding strength of the entire assembly and yet also serves as a guide-track for the carriage.

The corner posts having their respective upright members of respective sections interconnected to upright members of an adjacent section by bolts, and portions of which protrude from their respective corner posts in a way that might interfere with passage of the carriage except that the carriage is made so as to have open spaces extending vertically therethrough on the inner side of the corners of triangular frame portions of the carriage where the triangular frame portions extend beyond the posts, whereby the protruding bolt portions can be received in these open spaces for permitting the passage of the carriage freely over the bolts.

The aerial assembly having a winch for raising the carriage, the winch being located on the inside of the tower where it is less dangerous to passers by and where it does not interfere with the complete lowering of the carriage.

The aerial assembly having flexible anchoring assemblies each attached to a ground and extending upwardly to a hook which can be readily removed from the carriage for the storage of the anchoring assemblies out of the way where they are not lying about dangerously on the lawn on which children might be playing.

BRIEF DESCRIPTION OF THE DRAWING

FIG. 1 is a frontal elevation of the aerial assembly of this invention shown with its aerial standard in a downward or retracted position, parts being broken away to indicate the variable length, another part being broken away to show the method of attachment of vertical sections of the mast, and upper portions of stays being shown in place thereon. One of the upright portions of the lower section of the tower having a forward portion broken away for showing in full lines that a lower part of the adjacent upright of the next higher tower section is inserted into it and bolted to indicate that the tower itself which is used with the total assembly of this invention can be a standard sectional open bridge-work type of a tower.

FIG. 2 is a detail showing the aerial standard carriage and a portion of the aerial standard as it would be seen from the right-hand side in FIG. 1, upper portions of side stays being shown in place thereon.

FIG. 3 is a sectional view taken along the line 3—3 of FIG. 1, but with the view rotated 90° clockwise, and with upper portions of stay attachment hooks thereon.

FIG. 4 is a side view mast with stays and ground anchors with the aerial standard in upper position and with the stays taut.

DESCRIPTION OF THE PREFERRED EMBODIMENT

The aerial assembly of this invention is generally indicated at 10 in FIG. 1 and comprises a sectional upright tower 12, an elongated aerial standard 14, an aerial 20 attached to the standard 14, and aerial standard carriage 30 slidably attached to the tower 12 and movable upwardly and downwardly along the tower 12.

A hoisting and retaining assembly 20' is provided for hoisting or lowering the carriage 30 along the tower 12 and for retaining the carriage 30 in any desired position on the tower 12.

A pulley 60 is rotatably mounted on the upper end of the tower 12 and a flexible line 64 extends over the pulley 60 with one side portion 70 attached to the carriage by suitable means 70, the other side of the line 64 being shown at 72 and extending downwardly from the pulley 60 to a lower portion of the tower where it can be easily controlled by an operator on the ground for raising and lowering the tower, preferably by means of having the line portion 72 attached to a winch assembly 90 with crank handle 92 disposed close enough to ground level 98, or in other words, close enough to the bottom of the tower for easy success to the handle by a person standing on the ground, or standing on the upper side of a base 100 in which the tower 12 is mounted. The winch assembly 90 has a winch frame 91 attached to the tower.

The aerial standard 14 is preferably attached to the carriage 30 by means 120 permitting the aerial standard 14 to rotate in a horizontal plane with its lower end attached to the carrige 30 by means of a conventional aerial rotation controlling assembly 130 having as one of its parts a motor 132 of a reversible type, the directional control of which is made possible through a multiplicity of control wires in a cord 134 leading from the motor 132 to any suitable location such as the inside of a house or building.

The aerial 20 has a lead-in wire 150 which also leads to the interior of a house or building as desired, whereby the rotational position of the aerial 20 is controlled in a conventional manner.

More specifically, the tower 12 is preferably of a conventional triangular shape having three side posts 180 and the carriage 30 has upper and lower triangular frame portions 200 and 202 which snugly and slidably, but non-rotatably, fit the tower 12.

The upper and lower portions 200 and 202 are disposed outside of the outlines of the tower 12 as seen in FIG. 3 and, as seen in FIG. I, are interconnected by braces 205 whereby at least half of the area between the carriage upper and lower outside frame portions 200 and 202 is open for providing the carriage with a favorable lightness for ease of winching in proportion to its needed vertical size for ease of raising the light carriage 30 with a later described hand-winch. Two of the braces 205 are each inclined with respect to the vertical and horizontal.

The tower 12 has three vertical sections in the embodiment shown, these sections being shown at A, B, and C, each such section having three horizontally spaced upright corner members 250 which are arranged preferably in a triangle in any horizontal cross-section through the tower, and as best seen in FIG. 3.

Each section A, B, or C further comprises transverse members 260 which are transverse to and interconnecting each of the least three upright corner members 250 of each section.

The upright members 250 of each section are disposed in substantial alignment with and connected to one of the upright members of an adjacent section respectively. The form of interconnection is one that permits the sections to be shipped separately for compact shipping, but assembled together at the place of erection of the tower for use. For example, the lower end of each section A, B, or C can be of a smaller size to form an insertion portion 280 adapted to fit into the inside of the open upper side of the tubular adjacent corner member 250, bolt and nut assemblies 290 being used to make the assembly secure and extending through each of the interfitted upright corner members 250, the bolt and nut assemblies 290 also being called securing means 290.

The upright members 250 define the corners of the periphery of the triangular tower when the tower is seen in a transverse cross-section, and the corner posts 180 serve as guide tracks, and in fact, the tower itself serves as a guide track for the aerial standard carriage 30, with the three corner posts 180 providing the guiding surfaces for the carriage 30.

The carriage 30 has its upper and lower triangular frame portions 200 and 202 surrounding a sufficient part of the transverse periphery of the tower 12 for firmly holding the carriage 30 slidably on the tower 12. Further, the carriage 30 extends around at least three of the corners of the tower when the tower is seen in cross-section in FIG. 3.

As thus described, the tower 18 serves the first purpose of providing the main holding strength of the entire aerial assembly, and also serves the second purpose of providing a guide track for the carriage 30.

It is important that the three corner posts 180 and their upright corner members 250 of which the posts 180 are formed,. have outer surfaces sufficiently free of obstructions to passage of said carriage along the tower as to permit the carriage to move along at least one-third of the length of the tower, and preferably along two-thirds or more of the tower, as shown in FIG. 1.

It is preferable that the carrige 30 extend completely around the tower 12.

Since the motor 132 is reversible, it can be used for controllably rotating the standard 14 either clockwise or couner-clockwise, as it would be seen in top plan view, or in other words, in either direction about its vertical axis.

It will be seen that each of the bolt and nut assemblies 290 can also be called a securing means 290 having bolt shank 291 seen in FIGS. 3 and 5 protruding from a bolt head 292 seen in FIG. 5, the shank 291 extending through bolt holes 293 in the lapping interconnected ends $E_1$ and $E_2$ of two adjacent corner upright members 250, whereby a part of the securing means (defined by each bolt and nut assembly 290 and lapping of ends $E_1$ and $E_2$) protrudes transversely outwardly of a receptive upright member 250. However, the carriage is not prevented from travel on the tower by engagement with a bolt-head 292, for example, because the carriage has open spaces 300 extending vertically therethrough which are disposed outwardly of a respective corner post 180 in which a nut bolthead 292, of a bolt and nut assembly 290 can be received as the carriage 30 freely passes thereacross.

The winch assmbly 90 is disposed close enough to the ground level 98 for easy reach by a person standing on the ground, but the winch assembly 90 is preferably disposed on the inner side of the triangle formed by the three corner posts 180.

The winch assembly 90 has a frame 91 secured to one of the corner posts by bolts 400 and nuts 402, the bolts 400 each extending through one of the posts in a direction toward the area center of a triangular cross-section of the tower 12 so that the heads of the bolts 400 can be received in the spaces 300 to permit the carriage 30 to be lowered clear to the ground past the winch 90, when desired. The handle 92 of the winch defines a handle or controllable portion 92 of the carriage-hoisting and retaining assembly or carriage-raising and lowering means 20' defined by the pulley 60, flexible line 64 and the winch assembly 90. The carriage 30 and all elements attached to it with the exception of the aerial standard 14 and aerial 20 together define a carriage assembly 708. The carriage assembly 708 extends horizontally outwardly from the tower 12 less than twice the horizontal thickness of the tower, as seen in FIGS. 1 and 3.

The aerial assembly 10 is further seen in FIG. 4 to have a plurality of flexible anchoring assemblies generally indicated at 500, these being preferably three in number, and each having a ground anchor 502 at its lower end and each being attached to the carriage 30 at an upper end whereby the attachment to the carriage 30 serves to anchor the entire tower 12 without interfering with movements of the carriage 30 along the tower, as would be the case if the anchoring assembly 500 were attached to the tower, for example, at a midpoint and the carriage couldn't go past that point because of the interference with the anchoring assemblies.

Each anchoring assembly 500 is sufficiently long that it permits the carriage 30 to travel to its upper limit substantially at the top end of the tower without going off the top end of the tower, at which time, the anchoring assemblies 500 are substantially taut.

Each anchoring assembly can be formed of a cable 510 attached at one of its ends to a shortening and lengthening device, such as a turn-buckle 530 or other suitable device, so that after the carriage is at its full height or substantially taut, as achieved by the winch 90, the cables can be tightened further, if desired, for drawing them very, very taut by the use of the shortening devices 530.

The upper end of eachcable 510 can be attached to a hook 570 and each hook can be hooked over the top of the lower triangular frame portion 202 at a respective corner thereof with a portion of the hook extending downwardly into the respective space 300, as permits easy removal of the connection of the anchoring assemblies 500 to the tower so that they can be gotten out of the way and are not laying across a lawn where children might be playing and at times when the anchoring assemblies are not in use for supporting the tower itself.

Referring to FIG. 1, it will be seen that each post 180 has its lower end attached to a mounting plate 700 which is fixed by bolts 702 to a heavy concrete slab 720 set in the ground, the slab 720, mounting plate 700, and bolts 702, all forming parts of the base 100.

I claim:

1. An aerial assembly comprising an elongated upright tower, said tower having a plurality of upright assembled sections disposed one above the other, each section comprising at least three elongated horizontally spaced upright corner members and transverse members transverse to and interconnecting each of said at least three upright members, the said upright members of each said section each being disposed in substantial alignment with and connected to one of the upright members of an adjacent section respectively, said upright members defining corners of the periphery of the tower when the tower is seen in any transverse cross-section, an aerial carriage, an aerial means capable of receiving and conducting radio signals, means attaching said aerial means to said carriage, said aerial carriage being slidably attached directly to said tower and slidable upwardly and downwardly along said tower whereby said tower is itself a strong guide track for said carriage, said three upright corners members of said tower itself providing the guiding surfaces for said carriage, said carriage surrounding a sufficiebt part of the transverse periphery of said tower for firmly holding said carriage slidably on said tower, said carriage extending around at least three of the corner members of said tower, an elongated upright aerial standard, said tower serving the first purpose of providing the main upholding strength of said assembly and also serving the second purpose of providing a guide track for said carriage, said upright corner members having outer surfaces sufficiently free of obstruction to passage of said carriage along said tower as to permit said carriage to move along at least one-third of the length of said tower, and carriage raising and lowering means on said tower and connected to said carriage for moving said carriage upwardly on said tower, and said carriage raising and lowering means having a controllable portion within reach of an operator standing in a position with his feet adjacent a lower one-third portion of said tower whereby said operator while in said position can operate said controllable portion and thereby cause raising and lowering of said carriage along at least the majority of the height of said tower and also to the upper one-third portion of said tower, said raising and lowering means comprising a pulley attached to an upper portion of said tower, an elongated flexible member attached to said carriage and extending up and over said pulley and down said tower, said raising and lowering means comprising a winch attached to said flexible member, said winch having a winch-frame, means attaching said winch frame in a fixed relationship to said tower, the adjacent ends of each two adjacent aligned upright corner members having holes extending transversely therethrough and being connected by securing means having parts protruding from said holes respectively on the outer sides of said corner members respectively, said carriage having open spaces extending vertically therethrough in which said protruding parts of said securing means are received as said carriage freely passes thereacross.

2. The combination of claim 1 in which said carriage has a triangular frame portion extending around said tower, the corners of said triangular frame portion extending past respective corner upright members of said tower, whereby said open spaces in said carriage are disposed on the inner side of said corners of said triangular frame portions of said carriage.

3. The aerial assembly of claim 1 in which said aerial carriage has upper and lower portions extending substantially horizontally, and two elongated braces each inclined with respect to the vertical and horizontal and rigidly connected to said upper and lower carriage portions.

4. An aerial assembly comprising an elongated upright tower, said tower having a plurality of upright assembled sections disposed one above the other, each section comprising at least three elongated horizontally spaced upright corner members and transverse members transverse to and interconnecting each of said at least three upright members, the said upright members of each said section each being disposed in substantial alignment with and connected to one of the upright members of an adjacent section respectively, said upright members defining corners of the periphery of the tower when the tower is seen in any transverse cross-section, an aerial carriage, an aerial means capable of receiving and conducting radio signals, means attaching said aerial means to said carriage, said aerial carriage being slidably attached directly to said tower and slidable upwardly and downwardly along said tower whereby said tower is itself a strong guide track for said carriage, said three upright corner members of said tower itself providing the guiding surfaces for said carriage, said carriage surrounding a sufficient part of the transverse periphery of said tower for firmly holding said carriage slidably on said tower, said carriage extending around at least three of the corner members of said tower, an elongated upright aerial standard, said tower serving the first purpose of providing the main upholding strength of said assembly and also serving the second purpose of providing a guide track for said carriage, said upright corner members having outer surfaces sufficiently free of obstructions to passage of said carriage along said tower as to permit said carriage to move along at least one-third of the length of said tower, and carriage raising and lowering means on said tower and connected to said carriage for moving said carriage upwardly on said tower, and said carriage raising and lowering means having a controllable portion within reach of an operator standing in a position with his feet adjacent a lower one-third portion of said tower whereby said operator while in said position can operate said controllable portion and thereby cause raising and lowering of said carriage along at least the majority of the height of said tower and also to the upper one-third portion of said tower, said raising and lowering means comprising a pulley attached to an upper portion of said tower, an elongated flexible member attached to said carriage and extending up and over said pulley and down said tower, said raising and lowering means comprising a winch attached to said flexible member, said winch having a winch-frame, means attaching said winch frame in a fixed relationship to said tower, said winch being located on the inside of the space outlined by said upright members.

5. The aerial assembly of claim 4 in which said aerial carriage has upper and lower portions extending substantially horizontally, and two elongated braces each inclined with respect to the vertical and horizontal and rigidly connected to said upper and lower carriage portions.

* * * * *